US007690235B2

(12) United States Patent
Buenten et al.

(10) Patent No.: US 7,690,235 B2
(45) Date of Patent: Apr. 6, 2010

(54) METHOD OF AND DEVICE FOR COOLING AND OR LUBRICATION

(75) Inventors: Rolf Buenten, Aachen (DE); Hartmut Pawelski, Ratingen (DE); Ludwig Weingarten, Duesseldorf (DE); Heiner Siebel, Hilchenbach (DE); Hans-Peter Richter, Friedewald (DE); Klaus Grimm, Hilchenbach (DE); Dieter Daub, Hilchenbach (DE)

(73) Assignee: SMS Demag AG, Dusseldorf (DE)

( * ) Notice: Subject to any disclaimer, the term of this patent is extended or adjusted under 35 U.S.C. 154(b) by 80 days.

(21) Appl. No.: 11/596,780

(22) PCT Filed: May 9, 2005

(86) PCT No.: PCT/EP2005/004992

§ 371 (c)(1),
(2), (4) Date: May 18, 2007

(87) PCT Pub. No.: WO2005/115651

PCT Pub. Date: Dec. 8, 2005

(65) Prior Publication Data

US 2007/0210104 A1 Sep. 13, 2007

(30) Foreign Application Priority Data

May 18, 2004 (DE) ..... 10 2004 025 058

(51) Int. Cl.
*B21B 27/06* (2006.01)

(52) U.S. Cl. ..... 72/201; 72/43; 72/236

(58) Field of Classification Search ..... 72/41, 72/42, 43, 201, 236, 342.2, 342.3, 365.2, 72/44, 45

See application file for complete search history.

(56) References Cited

U.S. PATENT DOCUMENTS

| | | | | | |
|---|---|---|---|---|---|
| 3,277,686 | A | * | 10/1966 | James | 72/201 |
| 3,802,237 | A | * | 4/1974 | Albensi et al. | 72/8.7 |
| 5,090,225 | A | | 2/1992 | Schimon et al. | |

(Continued)

FOREIGN PATENT DOCUMENTS

| | | | |
|---|---|---|---|
| EP | 0794023 | | 9/1997 |
| JP | 54-82348 | * | 6/1979 |
| JP | 56-77013 | * | 6/1981 |
| JP | 11-5105 | * | 1/1999 |

*Primary Examiner*—Edward Tolan
(74) *Attorney, Agent, or Firm*—Abelman, Frayne & Schwab

(57) ABSTRACT

In a method of cooling and/or lubricating of rolls and/or rolling stock according to which a cooling medium is applied to the rolls from a plurality of nozzles/nozzle rows, on one hand, and for lubrication, on the other hand, base oil is applied to the rolling stock in front of a roll gap, wherein the nozzles/nozzle rows are adjusted separately and independent from each other the cooling medium is applied to the rolls separately from the base oil, and finally, the base oil without water as a base medium is applied directly to the rolling stock over an entire width thereof in a very small amount in comparison with a conventional amount.

To this end, media separating means is arranged between the nozzles/nozzle rows for applying cooling medium to the rolls and the nozzles/nozzle rows for applying base oil to the rolling stock.

7 Claims, 1 Drawing Sheet

U.S. PATENT DOCUMENTS 5,352,373 A * 10/1994 Goto ..... 508/400
5,524,465 A * 6/1996 Kajiwara et al. ..... 72/42
6,497,127 B2 * 12/2002 Nishiura et al. ..... 72/44
6,581,429 B1 * 6/2003 Takakura et al. ..... 72/236
7,143,499 B2 * 12/2006 Seidel et al. ..... 29/527.7
7,159,433 B2 * 1/2007 Seidel ..... 72/201

* cited by examiner

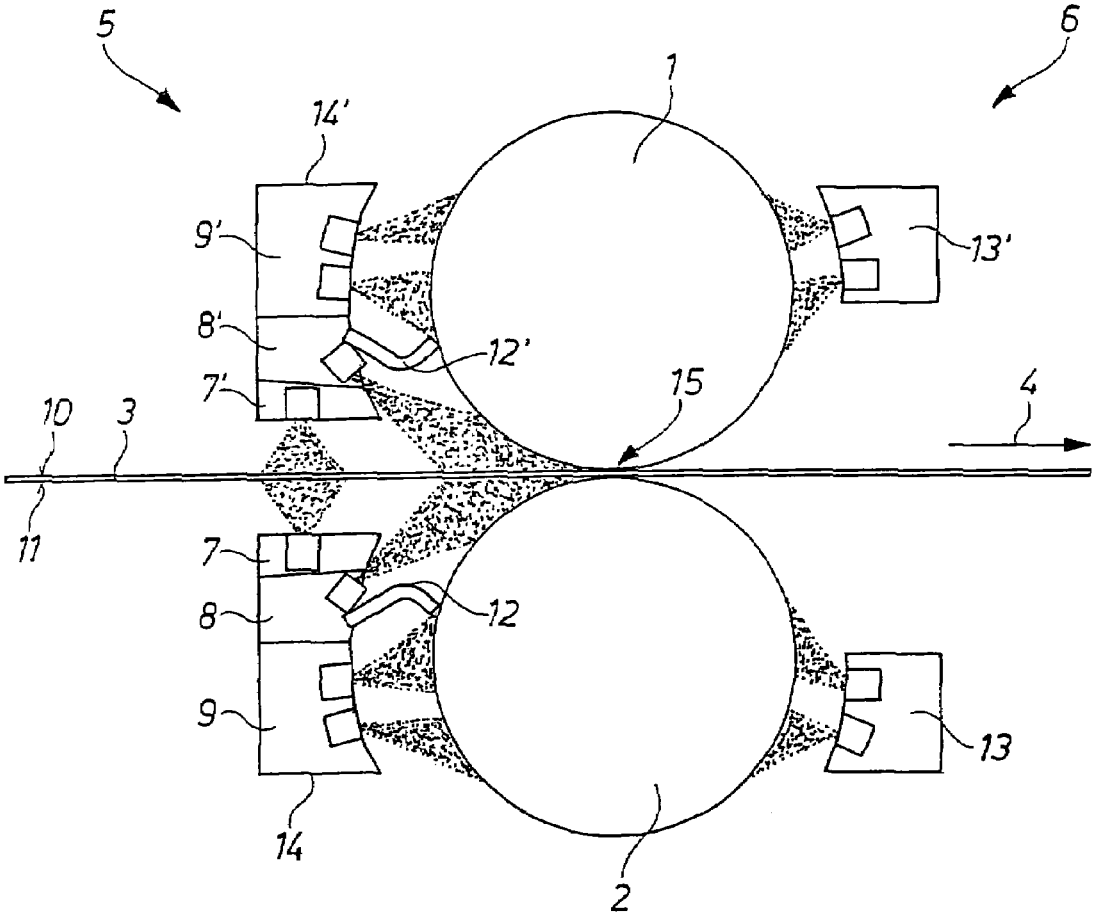
5
6
1
14'
9'
13'
8'
12'
7'
15
4
10
3
11
7
8
12
9
13
14
2

METHOD OF AND DEVICE FOR COOLING AND OR LUBRICATION

The invention relates to a method of and a device for cooling and/or lubricating of rolls and/or rolling stock according to which a cooling medium is applied to the rolls from a plurality of nozzles/nozzle rows, on one hand, and for lubrication, on the other hand, base oil is applied to the rolling stock in front of a roll gap, wherein the nozzles/nozzle rows are adjusted separately and independent from each other.

EP 0 054 172 A2 discloses influencing the frictional drag between the strip surface and the surface of the roll barrel shell by introducing a rolling emulsion therebetween for stress-free rolling of a cold strip. The rolling emulsion is fed dependent on partial tension stresses produced in zones lying in transverse direction of the strip behind the last rolling mill stand. In order to achieve short recovery time periods with small preparation, maintenance, and operational costs under prevailing operational conditions of cold rolling stands in steel and aluminum industry, base oil is added to the base medium water of the rolling emulsion in a predetermined amount determined by partial tension stresses and in locally limited regions before entry of the strip in the roll gap.

A local improved lubrication, which is achieved by applying locally lubrication components to the streaks of the to-be-rolled strip, should reduce locally the roll separating force and, thereby, the local peeling-off of the rolls, and the local end thickness of the strip is likewise reduced. Further, the flatness errors of the rolled strip are prevented because the frictional heating of the rolls is locally reduced in comparison with zone cooling.

German Patent DE 41 34 599 C1 discloses a hot rolling process and a hot rolling mill for a metal strip and having one or several rolling mill stands. In order to prevent surface defects of the working rolls, a cooling liquid is sprayed in a narrow region extending immediately in front of the roll gap over both the surface of the working rolls and of the metal strip. The temperature of the surface of the working roll shell is so adjusted that at least immediately in front of the roll gap, a temperature is reached that is below a boiling point of the cooling liquid.

EP 0 367 967 B1 discloses a method and a device in which, e.g., the concentration of the roll oil in an emulsion is purposefully influenced and the emulsion or dispersion, after exit from the roll gap or at discharge in front of the roll gap, is intercepted and is again separated. Thereby, it became possible to produce an emulsion or dispersion, which is delivered in the roll gap, with a predetermined concentration and to timely deliver it before drawing in the roll gap. The main point of this solution consists in actual production of the emulsion and in separation of the component media.

A common feature of known cooling and/or lubrication methods and/or devices is a non-effective delivery in a roll gap of the applied emulsion of a lubrication film which consists of the base medium water and an actual lubricating component (additive or oil). Insufficient lubrication results in an in adequate strip surface, in increased roll and strip or rolling stock temperatures, and in stand rattling that influences the surface quality, producing rattling marks on the surface of the rolling stock, which is a big drawback. An improvement cannot be achieved by using different components of the additive or by changing the rolling speed.

Accordingly, an object of the invention is a method and a device of the types described above but without the above-mentioned drawbacks and, in particular, with a noticeably improved lubrication in the roll gap.

This object is achieved according to the invention with a method in which the cooling medium is applied to the rolls separately from the base oil, and finally, the base oil without water as a base medium is applied directly to the rolling stock over an entire width thereof in a very small amount in comparison with a conventional amount.

The invention is based on a surprising recognition, which was confirmed by numerous experiments, that with a direct application of only the lubricating additive or oil, separately from the cooling medium, a complete effect of the lubricating additive in the roll gap is produced.

It was further recognized that a small amount, e.g., instead of conventional up to 4,000 l/min only about from 1 to 2 l per strip is sufficient because the oil can be deposited as an incompressible separating layer between the rolling stock and the rolls, in the roughnesses of the rolling stock surface. The case is different when a conventional large amount is applied, when the lubricating additive is almost completely peeled away without producing a desired effect.

The experiments with rolls from brass and copper showed, in addition, that despite the use, according to the invention, of a very small amount of oil, no increase of the rolling stock or strip temperature takes place, rather it is lower than with a conventional cooling process. The separation, according to the invention, of the cooling medium and oil or additive by sealing the rolls from the roll gap, the directly applied additive or oil cannot be washed up by the strip surface. Therefore, the friction between the rolls and the rolling stock is noticeably reduced, whereby simultaneously heat generation is substantially eliminated. However, a necessary low friction is maintained in order to be able to carry over the deformation of the rolling stock in the roll gap.

According to the invention, the base oil is applied at an entry side to the upper side and/or the lower side of the preferably cold-rolled rolling stock. Application to both upper and low sides can be appropriate, dependent on the material characteristics of the rolling stock.

When, advantageously, the cooling medium is applied to the rolls both at the entry side and the exit side, simultaneously with the strip cooling, washing of the working rolls takes place even before the rolls end the rotation toward the entry side. As has been established not only the service life of the working rolls is noticeably increased, but also in addition to almost perfectly clean rolls, the rolling stock surface is noticeably cleaner.

In the device for effecting the inventive method, media separation means is arranged between the nozzles/nozzle rows for applying cooling medium to the rolls and the nozzles/nozzle rows for applying base oil to the rolling stock, e.g., sealing in form of partitions. Thereby, the cooling medium is reliably separated from oil or additive, so that the additive/oil, which is directly applied to the rolling stock surface, cannot be washed up.

According to an advantageous embodiment of the invention, the base oil nozzles/nozzle rows are directed vertically toward the surface of the rolling stock and another base oil nozzles/nozzle rows are directed at an angle toward the roll gap. Thereby, the intended action of the additive/oil at the vent location, namely, in the roll gap, is achieved with the most possible action.

The manufacturing and assembly costs are reduced by arranging the nozzles/nozzle rows in a nozzle beam.

According to the invention, the nozzles/nozzle rows are adjusted independently of each other and are subjected to different pressures. For increasing the washing effect, advantageously, the cooling medium nozzles/nozzle rows, which are arranged at the exit side, are directed toward the rolls.

Further features and particularities of the invention follow from the claims and the following description of an embodiment based on a very schematic drawing. The single figure shows a side view of an inventive rolling device with nozzles/rows of nozzles for the rolling stock, roll gap, and rolls.

As shown, a rolling stock 3 is rolled out between an upper working roll 1 and a lower working roll 2 in a running direction indicated with arrow 4; the rolling stock, e.g., strip 3 is deformed in a roll gap 15 between the working rolls 1, 2.

At the entry side 5 of a rolling mill stand (not shown further), there are arranged nozzles/nozzle rows 7, 7' and 8, 8' or 9, 9' for the working rolls 1, 2 and of which the nozzles/nozzle rows 9, 9' apply, to the surface of the working rolls, 1, 2, cooling medium which is fed to the nozzle/nozzle rows 9, 9' from a supply source not shown. From nozzles/nozzle rows 7, 7' or 8, 8', which are separated from cooling medium nozzles/nozzle rows 9, 9' by partitions 12, 12', additive or oil is applied from nozzles/nozzle rows 7, 7' or 8, 8', directly, vertically through nozzles/nozzle rows 7, 7' to the upper and lower sides 10, 11 of the rolling stock 3, or through nozzles/nozzle rows 8, 8' at an angle, into the roll gap 15 and onto the rolling stock 3. The amount of the additive or oil, which is applied directly from the nozzles/nozzle rows 7, 7' or 8, 8' is very small and can, e.g., be supplied from a container. When the rolling mill stand with working rolls 1, 2 operates in reverse, corresponding nozzles/nozzle rows 7, 7', 8, 8' or 9, 9' can be provided at the exit side 6.

The nozzles/nozzle rows 7, 7', 8, 8', or 9, 9', which are arranged in nozzle beams 14, 14' in the shown embodiment, can be supplied and adjusted separately from one another, and be subjected to different pressures. Thus, e.g., for applying the additive or oil to the upper side 10 and/or to the lower side 11 of the rolling stock 3, the vertically directed nozzles/nozzle rows 7, 7' can be supplied with pressure from 2 to 5 bar, the nozzles/nozzle rows 8, 8', which direct the additive/oil at an angle in to the roll gap, can be supplied with pressure from 2 to 7 bar, and the nozzles/nozzle rows 9, 9', which applied a large amount of cooling medium to the working rolls 1, 2, can be supplied with pressure from 2 to 10 bar.

In each case, the large amount of cooling medium is separated from a small amount of the additive/oil, which is completely delivered in the roll gap 15, by seals which are formed in the discussed embodiment as partitions 12, 12'. In order to improve the cooling, on one side, and on the other side, cleaning of the working rolls 1, 2, there are provided nozzles/nozzle rows 13, 13' also on the exit side 6, which are directed toward the working rolls 1, 2.

The invention claimed is:

1. A method of cooling and/or lubricating rolls and/or rolling stock, comprising the steps of applying a cooling medium to the rolls from a plurality of nozzles/nozzle rows; applying, for lubrication purposes, base oil, without water as a base medium, directly to the rolling stock in front of a roll gap, the cooling medium being applied to the rolls separately from the base oil; and injecting, in the roll gap, base oil, without water as a base medium, in a very small amount in comparison with a conventionally used amount; whereby an incompressible separation layer is formed between the rolling stock and the rolls, wherein the step of applying cooling medium includes the step of applying, at an entry side, cooling medium to surfaces of the rolls from first nozzles/nozzles rows, and the step of applying base oil includes applying, at the entry side, base oil from second nozzles/nozzle rows at an angle into the roll gap and onto the rolling stock, and from third nozzles/nozzle rows vertically to upper side and lower side of the rolling stock, and wherein the step of applying cooling medium from first nozzles/nozzle rows includes applying cooling medium to both upper and lower rolls of the roll set, and the step of injecting base oil from the second nozzles/nozzle rows includes injecting base oil in the roll gap between a lower side of the rolling stock and the lower roll and between an upper side of the rolling stock and the upper roll, and wherein second and third nozzles/nozzle are being separated from the first nozzles/nozzle rows by partitions.

2. A method according to claim 1, wherein the step of applying the cooling medium to the rolls comprises applying the cooling medium both at entry side and exit side of the rolls.

3. A method according to claim 1, wherein the step of applying cooling medium comprises applying a large amount of cooling medium having a pressure from 2 to 10 bar, and the step of applying base oil comprises applying base oil from the second nozzles/nozzle rows with a pressure from 2 to 7 bar and applying base oil from the third nozzles/nozzle rows with a pressure from 2 to 5 bar.

4. A device for cooling and/or lubricating rolls and/or a rolling stock, comprising a first plurality of nozzles/a nozzle rows for applying a cooling medium to the rolls; a second plurality of nozzles/nozzle rows directed at an angle toward a roll gap for injecting, in the roll gap, base oil, without water as a base medium, in a very small amount in comparison with a conventionally used amount; and a third plurality of nozzles/nozzle rows for applying base oil, without water as a base medium, to the rolling stock and directed vertically toward a surface of the rolling stock;

wherein the first plurality of nozzles/nozzle rows, the second plurality of nozzles/nozzle rows, and the third plurality of nozzles/nozzle rows are all arranged at an entry side of the rolls, and wherein the first plurality of nozzles/nozzle rows includes first nozzles for applying cooling medium to both upper and lower rolls to the roll set, the second plurality of nozzles/nozzle rows includes second nozzles for injecting base oil in the roll gap between a lower side of the rolling stock and the lower roll and between an upper side of the rolling stock and the upper roll, wherein the third plurality of nozzles/nozzle rows includes third nozzles for applying base oil vertically to both the upper and lower sides of the rolling stock, and wherein the device further comprises media partition means for separating the first plurality of nozzles/nozzle rows from the second and third pluralities of nozzles/nozzle.

5. A device according to claim 4, wherein the nozzles/nozzle rows are adjusted independently of each other.

6. A device according to claim 4, wherein the nozzles/nozzle rows are subjected to different pressures.

7. A device according to claim 4, wherein the cooling medium nozzles/nozzle rows (13, 13'), which are arranged at an exit side of the rolls are directed toward the rolls.

* * * * *

UNITED STATES PATENT AND TRADEMARK OFFICE

CERTIFICATE OF CORRECTION

PATENT NO. : 7,690,235 B2
APPLICATION NO. : 11/596780
DATED : April 6, 2010
INVENTOR(S) : Ralf Buenten et al.

It is certified that error appears in the above-identified patent and that said Letters Patent is hereby corrected as shown below:

Title Page, Item (73) Assignee Should Read
--SMS Siemag AG, Duesseldorf (DE)--.

Signed and Sealed this

Twenty-third Day of November, 2010

David J. Kappos

David J. Kappos
*Director of the United States Patent and Trademark Office*